United States Patent [19]

Tada et al.

[11] 4,234,127

[45] Nov. 18, 1980

[54] MANUALLY OPERATED SPRAYER

[75] Inventors: Tetsuya Tada, Tokyo; Masaharu Amari, Onoda, both of Japan

[73] Assignee: Canyon Corporation, Tokyo, Japan

[21] Appl. No.: 932,404

[22] Filed: Aug. 9, 1978

[30] Foreign Application Priority Data

| | | | |
|---|---|---|---|
| Feb. 1, 1978 | [JP] | Japan | 53/10937[U] |
| Apr. 14, 1978 | [JP] | Japan | 53/43265 |
| May 22, 1978 | [JP] | Japan | 53/68756[U] |

[51] Int. Cl.[2] ..... B05B 9/43

[52] U.S. Cl. ..... 239/333; 222/321; 222/533

[58] Field of Search ..... 239/331, 333; 222/321, 222/385, 533

[56] References Cited

U.S. PATENT DOCUMENTS

| | | | |
|---|---|---|---|
| 3,148,806 | 9/1964 | Meshberg | 222/533 X |
| 4,017,031 | 4/1977 | Kishi et al. | 239/333 |
| 4,051,983 | 10/1977 | Anderson | 222/321 |

FOREIGN PATENT DOCUMENTS

| | | | |
|---|---|---|---|
| 2346056 | 10/1977 | France | 222/321 |

*Primary Examiner*—James B. Marbert

*Attorney, Agent, or Firm*—Frishauf, Holtz, Goodman & Woodward

[57] ABSTRACT

A manually operated sprayer which comprises a pump mechanism including a secondary valve having a valve body normally pressed against a valve seat by a compression spring and valve-sealing means designed temporarily to obstruct the flow of a liquid even after the valve body slides in liquidtightness along the inner wall of a tubular piston and is released from the valve seat, and wherein the valve-sealing means of the secondary valve is integrally formed with the valve body, and slides in liquidtightness along the inner wall the tubular piston for a prescribed distance to be brought into an annular groove formed in the inner wall of the tubular piston, thereby taking the form of a skirt-like strip to be released from the liquidtight condition.

16 Claims, 10 Drawing Figures

FIG. 8
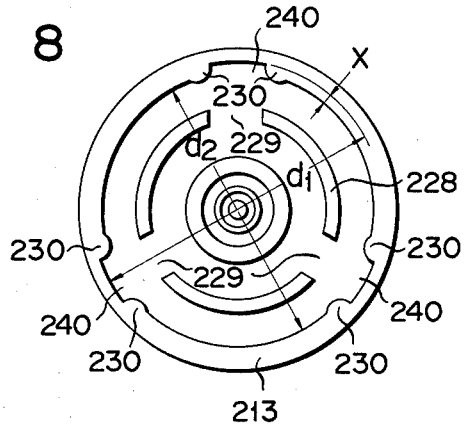
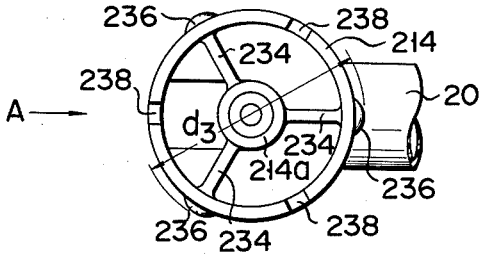
FIG. 9
FIG. 10
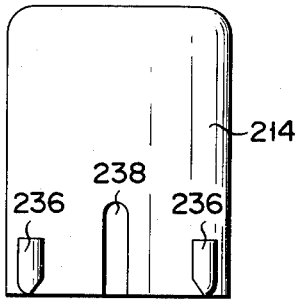

MANUALLY OPERATED SPRAYER

BACKGROUND OF THE INVENTION

This invention relates to a manually operated sprayer designed to suck up a liquid received in a container into a cylinder by the slide of a piston and spray the liquid under pressure.

A known manually operated sprayer is the type which is so constructed as to cause spraying to be commenced after a piston has follow by a prescribed stroke, instead of immediately after the start of the piston fall, namely, with the so-called rise of a mass of atomized liquid taken into account and in which the downward stroke of the piston deading to the rise of the atomized liquid mass is utilizes to increase the pressure of the liquid received in the cylinder. The proposed pressure-accumulating type manually operated sprayer includes the U.S. Pat. No. 3,399,836 (allowed to Pechstein), U.S. Pat. No. 3,761,022 (allowed to Kondo) and U.S. Pat. No. 3,921,861 (allowed to Kondo). However, any of the prior art sprayers is so designed as to spray immediately after the liquid received in the cylinder is pressurized to a certain level. Therefore, the customary sprayer has the drawback that a mass of atomized liquid does not rise satisfactorly.

SUMMARY OF THE INVENTION

It is accordingly an object of this invention to provide a manually operated sprayer in which a mass of atomized liquid can be made to rise in a more improved condition.

To this end, the present invention provides a manually operated sprayer wherein a secondary valve comprises a valve body normally pressed against the valve seat by a compression spring and valve sealing means such as a skirt-like strip which is designed temporarily to abstruct the flow of a liquid even after the valve body slides in liquidtightness along the inner wall of a piston and is released from the valve seat. As described above, the valve-sealing means of the secondary valve may take the form of a skirt-like strip which slides in liquidtightness along the inner wall of a tubular piston for a certain distance to be brought into an annular groove formed in the inner wall of the tubular piston, thereby to be released from the liquidtight condition.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWING

FIG. 8 is a plan view of the manually operated sprayer of FIG. 7 with the push button and piston take off;

FIG. 9 is a bottom view of the push button fitted to the manually operated sprayer of FIG. 7; and FIG. 10 is a lateral view of the push button as taken in the direction of an arrow A indicated in FIG. 9.

DETAILED DESCRIPTION OF THE PREFERRED EMBODIMENTS

There will now be described by reference to the accompanying drawing a manually operated sprayer according to the preferred embodiments of this invention.

Figure 1:
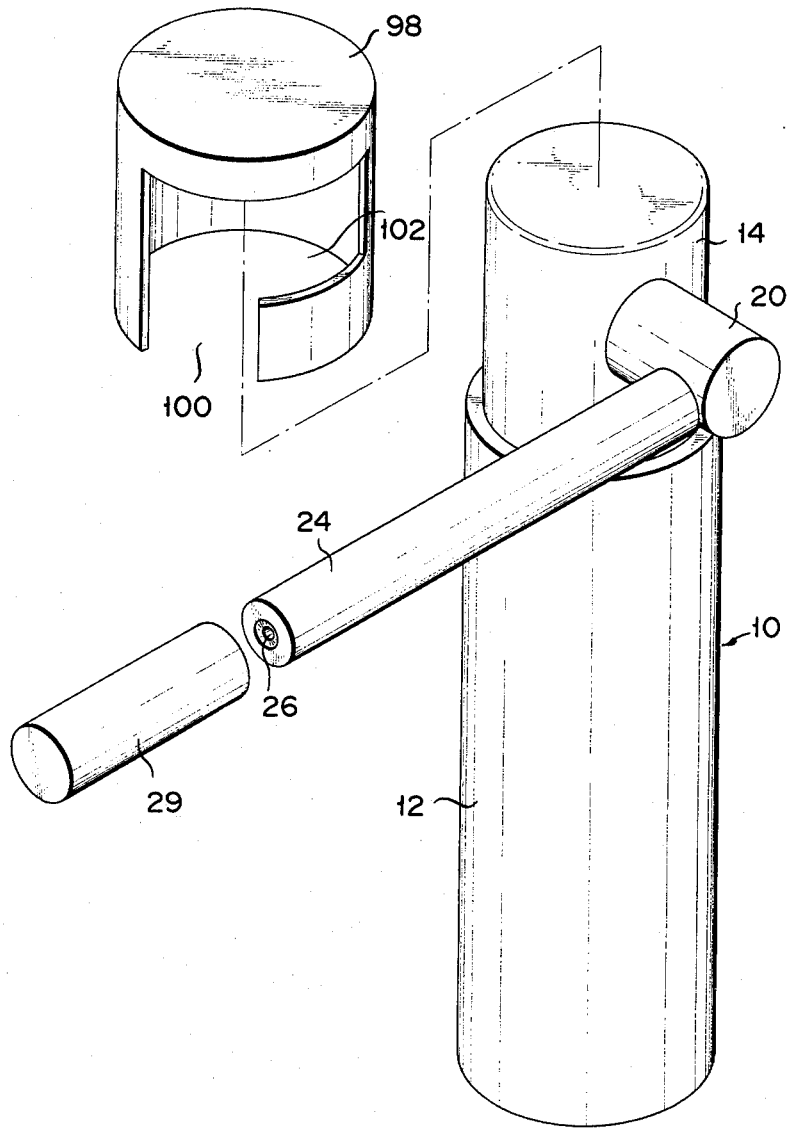
FIG. 1 is an exploded perspective view of a manually operated sprayer according to one embodiment of this invention.
Figure 2:
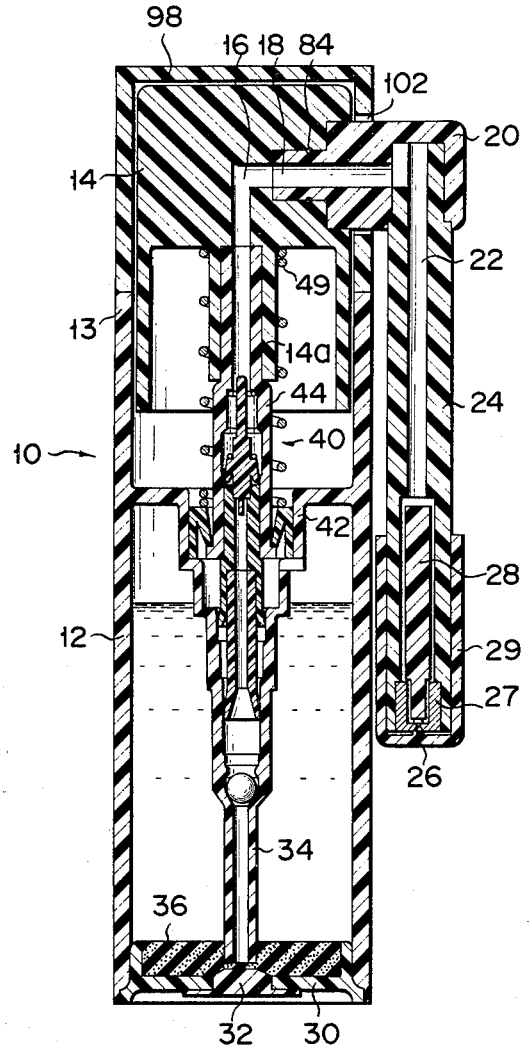
FIG. 2 is a longitudinal sectional view of the sprayer of FIG. 1.

Referring to FIGS. 1 and 2, a manually operated sprayer 10 is provided with a vertically movable and rotatable plastics push button 14 received in a push button housing 13 disposed on a liquid container 12. The liquid container 12 is generally formed of a body and upper and lower covers. The body and upper cover of the indicated liquid container 12 and push button housing 13 are integrally formed of an injection molding of plastics material, thereby decreasing a number of parts and ensuring the easy assembly of a sprayer. Obviously, a separate push button housing 13 may be set on the liquid container 12, instead of being integrally formed with the liquid container 12.

Rotatably fitted to the lateral wall of the push button 14 is a joint 20 provided with a lateral liquid path 18 communicating with an axial liquid path 16 formed in the push button 14. The lateral wall of the joint 20 is fitted with an elongate nozzle 24 in which a liquid path 22 is formed for communication with the lateral liquid path 18. The elongate nozzle 24 well serves the purpose, if it extends along the axis of the liquid container 12. On instead, the elongate nozzle 24 may be fitted to the free end of the joint 20, instead of to the lateral wall thereof and then bent axially. The forward end of the elongate nozzle 24 is fitted with a nozzle chip 27 bored with an ejection hole 26. A spinner 28 is received in the liquid path 22 at a point adjacent to the nozzle chip 27. Further, a nozzle cap 29 is detachably fitted to the forward end of the elongate nozzle 24 to enclose the ejection hole 26.

A spraying direction can be freely determined in a plane parallel with the axis of the push button 14 by rotating both joint 20 and elongate nozzle 24 relative to the push button 14. Rotation of the push button 14 which is rotatably received in the push button housing 13 naturally leads to the rotation of the joint 20 and elongate nozzle 24. Accordingly, the spraying direction can be freely defined in a plane perpendicular to the axis of the push button 14. After all, the spraying direction can be set in any of the three-dimensional directions, thereby broadening the scope in which the present manually operated sprayer is applied.

A lower cover 30 is fixed to the lower opening of the liquid container 12. A plug 32 is detachably fitted to the lower cover 30 to effect the charge and replenishment of a liquid. Received in the lower cover 30 is a hygroscopic material 36 such as sponge. Even where, therefore, the liquid container 12 is used in an inclined position, a liquid can be sucked in through the hygroscopic material 36, thus always ensuring spraying.

Figure 3:
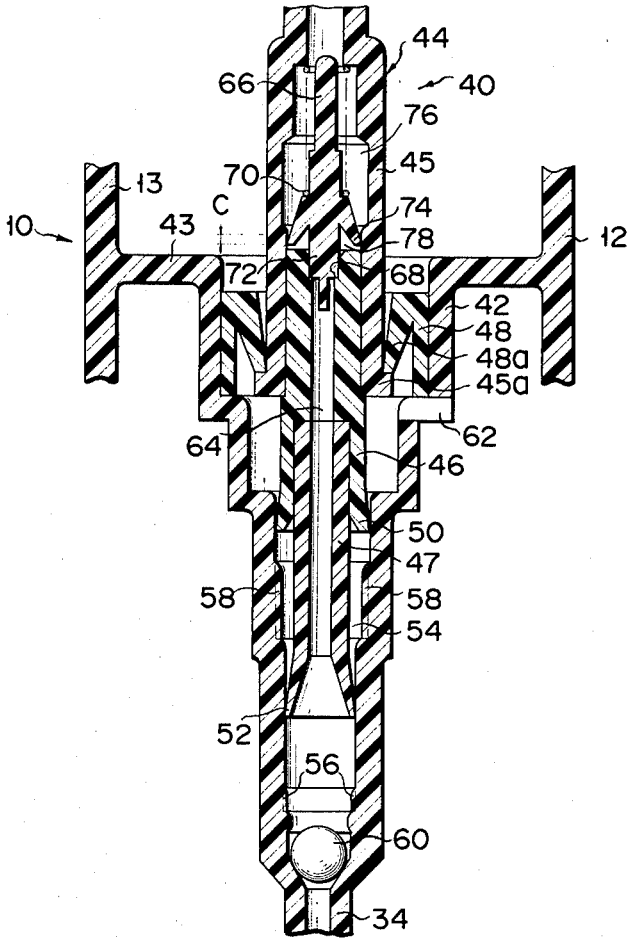
FIG. 3 is an enlarged longitudinal sectional view of a pump mechanism used with the sprayer.

FIG. 3 shows the detailed arrangement of a pump mechanism 40 fitted to the sprayer 10. The cylinder 42 is integrally formed with the liquid container 12 by means of an inner flange 43. The lower end portion of the cylinder 42 extends as a suction pipe 34. The pump mechanism 40 comprises a tubular piston 44 sliding through the cylinder 42. The piston 44 is formed of three jointly movable piston units 45, 46, 47 which are fitted into each other in a vertical direction. The first piston unit 45 of the pump mechanism 40 is fitted into a support cylinder 14*a* of the push button 14. A negative pressure packing 48 is provided between the first piston unit 45 and cylinder 42 to prevent negative pressure from occurring in the liquid container. A compression coil spring 49 is set between the packing 48 and push button 14. The skirt section 48*a* of the packing 48 is pressed against the shoulder section 45*a* of the first piston unit 45 to ensure a sealing effect. Abutment of the shoulder section 45*a* of the first piston unit 45 against the skirt section 48*a* of the packing 48 prevents the loosening of the piston 44 from the cylinder 42 which might otherwise occur against the biasing force of the compression coil spring 49. A skirt-like piston-sealing strip 50 is formed on the lower peripheral wall of the second piston unit 46. Similarly, a skirt-like piston-sealing strip 52 is formed on the lower peripheral wall of the third piston unit 47. Both sealing strips 50, 52 define a space 54 in which a resident mass of pressurized liquid is retained. For example, four equiangularly arranged ribs 56 are provided on that portion of the inner wall of the cylinder 42 which lies close to the lower dead point of the piston 44, namely, the lower dead point of the third piston unit 47 for partial deformation of the sealing strip 52 of the third piston unit 47 in order to release a mass of pressurized liquid remaining in the cylinder 42 into the retention space 54. Another group of four equiangularly arranged ribs 58 are formed on the inner wall of the cylinder 42 for partial deformation of the reading strip 54 of the second piston unit 46. Referential numeral 60 denotes a primary valve, and referential numeral 62 shows a discharge path for returning a mass of pressurized liquid left in the above-mentioned retention space 54 into the liquid container 12.

An axially extending liquid path 64 is formed in the piston 44. A secondary valve 66 is provided in the liquid path 64. The secondary valve 66 comprises a valve body 72 which is normally pressed against a valve seat 68 by a compression coil spring 70, thereby closing the liquid path 64 so as to admit of its opening only when required. The secondary valve 66 further comprises valve-sealing means such as a skirt-like valve-sealing strip 74 which temporarily abstructs the flow of a liquid even after the valve body 72 is removed from the valve seat 68. The valve-sealing strip 74 is designed to slide in liquidtightness along the inner wall of the first piston 45 for a prescribed distance C and then be brought into an annular groove 76 formed in the inner wall of the first piston unit 45. Accordingly, a liquid flowing between the valve body 72 and valve seat 68 is temporarily hold in a space 78 defined by the valve-sealing strip 74. The valve body 72 and valve-sealing strip 74 should preferably be integrally formed in order to decrease a number of parts and simplify the construction of a sprayer.

Where the skirt—like valve-sealing strip 52 is deformed by the ribs 56 in the proximily of the lower dead point of the piston 44, than a mass of pressurized liquid remaining in the cylinder flows into, the retention space 54 through the skirt—like valvesealing strip 52. Where the piston 44 is released from a downward pressing force, then the valve body 72 of the secondary valve 66 is pressed against the valve seat 68 by a compression coil spring 70 to close the liquid path 64. The piston 44 is also pushed upward by the spring 70 and rises until the shoulder portion 45*a* of the first piston unit 45 is caught by the negative pressure packing 48. Therefore, a liquid is sucked from the container 12 into the cylinder 42 through the primary valve 60. Where a downward pressing force is applied to the piston 44 ready for the succeeding spraying operation, a liquid in the cylinder is more pressurized. Where a pressure applied to the secondary valve 66 overcomes the biasing force of the compression spring 70, then the secondary valve 66 is moved upward to remove the valve body 72 from the valve seat 68. While, however, the skirt—like valve-sealing strip 74 is not moved further upward for a prescribed distance C (FIG. 3), the pressurized liquid ceases to run and is temporarily hold in the retention space 78. The piston 44 is moved further downward to cause the valve-sealing strip 74 to be shifted for the prescribed distance C. The downward stroke of the piston 44 at this time is utilized to increase the pressure of a liquid hold in the retention space 78. Where the valve-sealing strip 74 is brought into the annular groove 76 to be released from its liquidtight condition, and the secondary valve 66 is opened, then the liquid is fully pressurized, thereby ensuring a spraying operation with the satisfactory rise of a mass of atomized liquid. Where the liquid pressure falls, the valve-sealing strip 74 is released from the annular groove 76 by the biasing force of the compression coil spring 70 to be quickly set again in a liquidtight condition, thereby enabling the spraying operation to be stopped instantly. When the piston 44 falls, a liquid received in the cylinder 42 and a pressurized liquid left in the retention space 54 are further pressurized, presenting an increased resistance to the descent of the piston 44. Therefore, it would be necessary to apply a greater force in order to effect the fall of the piston 44 against the resistance. At this time, however, the skirt—like valve-sealing strip 50 is deformed by the ribs 58, causing the prescribed liquid left in the retention space 54 to be released upward by means of the deformed valve-sealing strip 50. Therefore, the falling piston 44 is saved from the resistance offered by the pressurized liquid remaining in the retention space 54, and can smoothly fall, thereby enabling the force to depress the piston 44 to be utilized solely to pressurize a liquid received in the cylinder 42. A proper combination of a point of time at which the above-metioned resistance applied to the falling piston 44 begins to decrease and a point of time at which the secondary valve section 66 is opened enables a mass of atomized liquid to rise in a more satisfactory condition.

Figure 4:
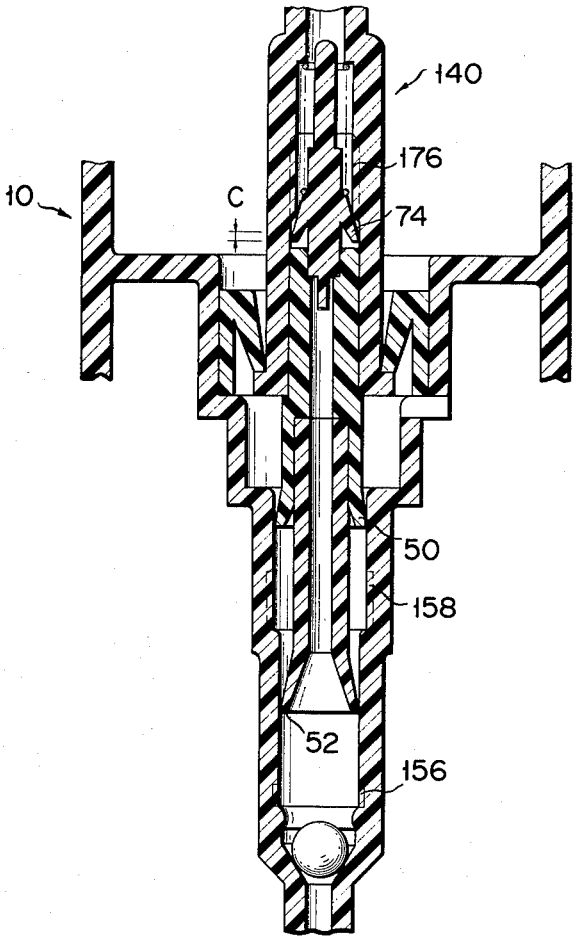
FIG. 4 is an enlarged sectional view of a modification of the pump mechanism.

There will now be described by reference to FIG. 4 a modification 140 of the pump mechanism of FIG. 3. With this modification of FIG. 4, the annular groove 76 of FIG. 3 is replaced by, for example, four ribs 176. The ribs 56, 58 of FIG. 3 are substituted by annular grooves 156, 158. This modified pump mechanism 140 can perform the same function as the pump mechanism 40 of FIG. 3.

The skirt—like valve sealing strips 50, 52, 74 can obviously be released from the liquid tight condition by many other combinations of ribs and annular, grooves than those described in connection with FIGS. 3 and 4.

Figure 5:
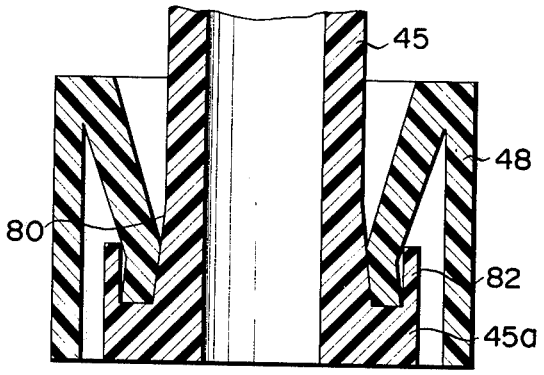
FIG. 5 is an enlarged longitudinal sectional view of a modification of the negative pressure packing of the pump mechanism used with the sprayer.

With the pump mechanism 40, 140, the packing 48 has its skirt section 48*a* pressed against the shoulder 45*a* of the first piston unit 45, thereby sealing the piston 44 and preventing its loosening. The first piston unit 45 may comprise, as shown in FIG. 5, a shoulder 45*a* provided with a tapered section 80 and a projection 82 which extends from the shoulder 45*a* toward the packing 48 and whose inner plane is made flat. With the first piston unit 45 constructed as described above, the packing 48 is deformed by being pressed against the tapered section 80 by the projection 82. Thus the inner edge of the projection 82, the upper surface of the shoulder 45*a* and the tapered section 80 jointly carry out triple sealing and more reliably prevent the loosening of the piston 44.

Figure 6:
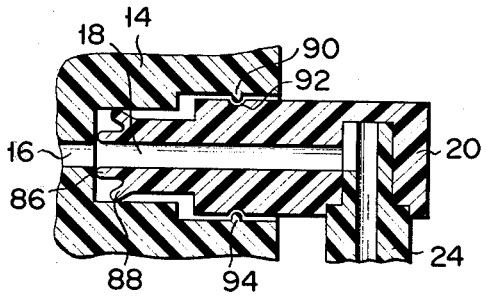
FIG. 6 is an enlarged longitudinal sectional view of a modification of a joint fitted to the sparyer.

The joint 20 is securely sealed by an O-ring 84 (FIG. 2). Further as seen from FIG. 6, the forward end of the joint 20 is fitted with an annular sealing strip 86 and the lateral wall of the end is provided with a skirt—like sealing strip 88, thereby ensuring double sealing. The joint 20 is fitted to the push button 14 by snapping means 94 consisting of a projection 90 and annular groove 92 (FIG. 6). The projection 90 may take a fully annular or partly annular form. With the indicated modification, the projection 90 is formed on the push button 14, and the annular groove 92 is provided in the joint 20. However, the reverse arrangement can still ensure snapping with the same effect.

The above-mentioned type of sprayer is generally transported or marketed with a sprayer body fitted to a container fully filled with a liquid. Where, therefore, a piston-actuating push button is accidentally depressed during packing, transport or a sales exhibition, then difficulties arise that a liquid received in the container is wasted by being unnecessarily ejected through a ejection hole of a nozzle with possible contamination of the surroundings.

The sprayer 10 of this invention comprises, as shown in FIG. 1, a safety device 98 which prevents the push button 14 from being freely depressed and allows the depression only in need of spraying, thereby suppressing the accidental or careless ejection of a liquid. The safety device 98 includes a push button cover which encloses the push button 14, and is set on the container 12 so as to abut against the upper edge thereof. A vertical groove 100 extending axially of the safety device 98 and a horizontal groove 102 intersecting the vertical groove 100 at right angles are cut out of the peripheral wall of the safety device 98. This safety device 98 is set on the container 12 from above the push button 14 so as to cause the joint 20 to be fitted into the vertical groove 100 of the safety device 98, and later is slightly rotated to admit of the insertion of the joint 20 into the horizontal groove 102. The push button 14 enclosed, as shown in FIG. 2, in the safety device 98 is prevented from being depressed. Further, when the push button 14 is depressed, the joint 20 abuts against the lower edge of the horizontal groove 102 and is prevented from falling, thereby reliably suppressing the accidental ejection of atomized liquid.

There will now be described by reference to FIG. 7 a manually operated sprayer 110 according to a second embodiment of this invention. The sprayer 110 of FIG. 7 has substantially the same constituent members as those of the sprayer 10 according to the first embodiment, except for a safety device 198 which is of a different type from that of the sprayer 10. The parts of FIG. 7 the same as those of FIG. 3 are respectively denoted by the same numeral (if differently shaped from those of the first embodiment, the parts of FIG. 7 are marked by separate numerals).

Figure 7:
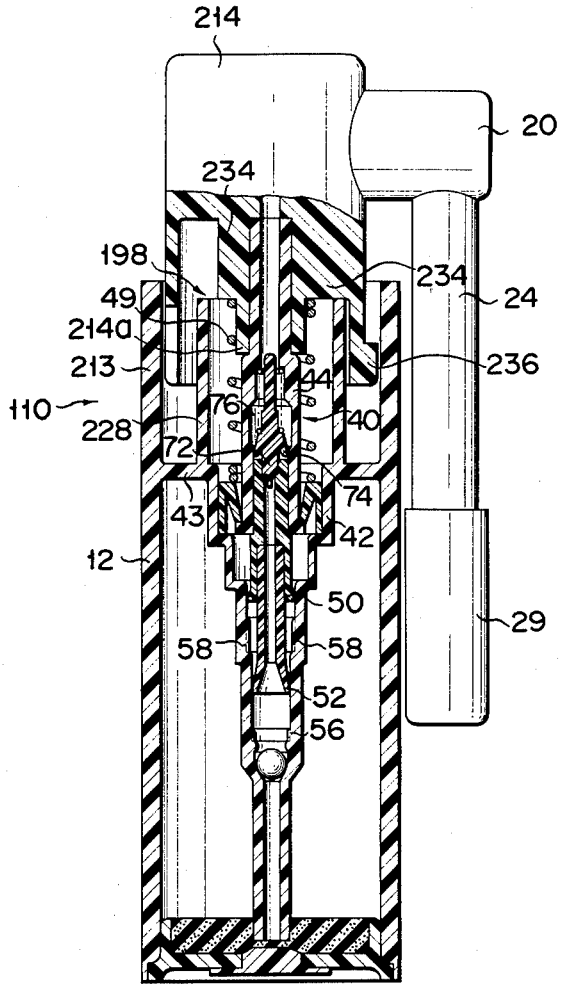
FIG. 7 is a longitudinal sectional view of a manually operated sprayer according to a second embodiment of the invention.

As seen from FIG. 7, the safety mechanism 198 of the sprayer 110 comprises an integrally formed notched stopper 228 projecting above the inner flange 43 of the liquid container 12. With the embodiment of FIG. 7, the stopper 228 has a cylindrical form, but may be shaped into any other form. As apparent from FIG. 8, three notches 229 vertically extending along part of the stopper 228 are equiangularly arranged as viewed in the circumferential direction. However, this invention is not limited to such arrangement. It is possible to provide a single notch or four or more equiangularly arranged notches. A push button housing 213 comprises three pairs of, for example, partly spherical projections 230 formed on those portions of the inner wall of the housing 213 which lie behind the respective notches 229. The wall thickness of the push button housing 213 is changed stepwise as viewed in the circumferential direction. Namely, those portions of the inner wall of the push button housing 213 which lie behind the notches 229 have a thickness smaller by X than the other portions of the inner wall which are more removed from the notches 229 by the respective pairs of partly spherical projection 230 and recesses 240. With $d_1$ taken to denote the inner diameter of the thicker wall portion of the push button housing 213 and $d_2$ the inner diameter of the thinner wall portion thereof, then there results the following equation:

$$d_1 - d_2 = 2X$$

As apparent from FIG. 9, the push button 214 comprises, for example, three radially extending ribs 234 disposed between a support cylinder 214*a* into which the piston 44 of the pump mechanism 40 is fitted and the inner wall of the push button 214. The ribs 234 are equiangularly arranged to match the notches 229. Obviously, the number and arrangement of the ribs 234 may vary with those of the notches 229. A partly columnar depression projection 236 is provided at the lower end of the respective portion of the periphery of the push button 214 which face the imaginary extensions of the radially arranged ribs 234. The lower end of the projection 236 is shaped into a partly spherical form. An elongate slot 238 (FIG. 10) is bored between the respective adjacent projections 236. The projection 236 is so shaped as to depress the thicker wall portion of the push button housing 213, but not the thinner wall portion thereof. An imaginary circle in which the projections 236 are inscribed has a diameter $d_3$ which has the following relationship with the aforesaid inner diameters $d_1$, $d_2$:

$$d_2 < d_3 < d_1$$

The push button 214 and push button housing 213 are made of plastic material. The slots 238 are based in the push button 214. Therefore, the push button 214 can be easily inserted into the housing 213, though the diameter of the aforesaid imaginary circle inscribed by the projection 236 is larger than the inner diameter of the thicker wall portion of the push button housing 213. Further, the partly spherical form of the lower end of the projection 236 more facilitates the insertion. After the push button 214 is brought into the housing 213, the projections 236 of the push button 214 are tightly pressed against the thicker wall portion of the housing 213 by a spring force resulting from the presence of the slots 238. According to the above-mentioned construction, the ribs 234 of the push button 214 are positioned above the stoppers 228 so as to cross them spatially. If, therefore, accidentally depressed, the push button 214 is prevented from falling due to the ribs 234 immediately abutting against the stopper 228, thereby fully suppressing the unnecessary or accidental spray of a liquid.

Required spray can be effected by rotating the push button 214 to align the ribs 234 with the notches 229. Since the projections 236 are tightly pressed against the inner wall of the housing 213, the push button 214 can be depressed against a friction occurring between the projections 236 and the inner wall of the housing 213. Where the push button 214 is turned against the above-mentioned frictional force until the projections 236 are brought into the recesses 240 lying between the respective partly spherical projections 230, then the ribs 234 are shifted from the position above the cylindrical stopper 228 in which the ribs 234 spatially cross the stopper 228, to be brought above the notches 229.

The recess 240 lies between the paired partly spherical projections 230. Where, therefore, the push button 214 is rotated clockwise or counterclockwise, the depression projections 236 about against the partly spherical projections 230, and then are inserted into the recesses 240 after temporarily undergoing a great resistance. Since, at this time, the depression projections 236 are loosely fitted into the recesses 240, the push button 214 can be rotates freely, thereby making it possible easily to recognize that the depression projections 236 are inserted into the recesses 240. Conversely, this means that it is also possible readily to find that the depression projections 236 do not lie in the recesses 240. Where, under the above-mentioned condition, the push button 214 is depressed, then the ribs 234 move through the notches 229, thereby enabling required spraying to be effected without abstracting the depression. The partly columnar form of the repression projection 236, the partly spherical form of the projections 230 and the presence of the slots 238, cooperate to ensure the easy insertion of the depression projections 236 into the recesses 240, though a great resistance is temporarily applied to the depression projections 236.

There will now be described by reference to FIG. 7 a manually operated sprayer 110 according to a second embodiment of the invention. This sprayer 110 comprises the same type as the pump mechanism 40 of the manually operated sprayer 10 of FIG. 2. The sprayer 110 according to the second embodiment enables a mass of atomized liquid to rise satisfactorily without the accompaniment of any residual ejection of the liquid, once spraying is stopped. The second embodiment also comprises a safety device 198. This safety device 198 is provided with readially extending ribs formed on the inner wall of the rotatable push button, a stopper provided in the push button housing and designed to prevent the depressing the push button when the ribs abut against the stopper, and notches to admit of the descent of the ribs. Where the ribs of the push button lie above the stopper, the push button is prevented from being depressed. Where the ribs are positioned above the notches, the push button can be depressed. Where, therefore, a force is accidentally applied to depress the push button while spraying is not required and in consequence the ribs lie above the stopper, then the depression is obstructed, thereby preventing the occurrence of accidents. Required spraying can be effected by rotating the push button until the ribs are brought above the notches.

For the safety device 198 of the sprayer 110, it is preferred to form projections on the periphery of the push button in order to depress the inner wall of the push button housing, integrally form the stopper with the push button housing, and form recesses in those portions of the inner wall of push button housing which lie behind the notches of the stopper, thereby allowing the depression projections to be loosely fitted into the recesses. This construction causes the depression projections to be looosely fitted into the recesses only when spraying is required. Unlike the case where spraying is impossible, the push button is freely rotated, though with a frictional resistance resulting from the depression of the inner wall of the push button housing by the depression projections. Therefore, the free rotation of the push button readily and reliably proves that spraying can be undertaken, offering great advantage in applying the sprayer. Obviously, the safety device 198 is applicable to the ordinary push button type sprayer lacking an elongate nozzle.

What we claim is:

1. In a manually operated sprayer provided with a pump mechanism for sucking up a liquid received in a container into a cylinder through a primary valve when a piston slides upward, pressurizing the liquid and spraying it through a secondary valve, the improvement wherein:

said secondary valve of the pump mechanism comprises a valve body normally pressed against a valve seat by a compression spring, the piston being a tubular piston; valve sealing means sliding in liquid-tightness along the inner wall of the tubular piston, thereby temporarily obstructing the flow of the liquid even after the valve body is removed from the valve seat; and valve seal-releasing means for releasing the valve-sealing means from its liquid-tight condition after the valve-sealing means has slid over a prescribed distance; and said pump mechanism further comprises a pair of skirt-like piston-sealing strips spatially provided on the periphery of the piston to define a retention space therebetween for a mass of pressurized liquid left in the cylinder; and piston seal-releasing means which, when the piston falls to the proximity of its lower dead point, discharges a mass of pressurized liquid left in the cylinder into the retention space by means of a sealing strip disposed on the side of the primary valve, and, when the piston falls for a prescribed distance before reaching its lower dead point, discharges a mass of pressurized liquid remaining in the retention space by means of a sealing strip positioned on the side of the secondary valve section.

2. In a manually operated sprayer provided with a pump mechanism for sucking up a liquid received in a container into a cylinder through a primary valve when a piston slides upward, pressurizing the liquid and spraying it through a secondary valve, the improvement wherein:

said pump mechanism comprises a pair of skirt-like piston-sealing strips spatially provided on the periphery of the piston to define a retention space therebetween for a mass of pressurized liquid left in the cylinder; and piston seal-releasing means which, when the piston falls to the proximity of its lower dead point, discharges a mass of pressurized liquid left in the cylinder into the retention space by means of a sealing strip disposed on the side of the primary valve, and, when the piston falls for a prescribed distance before reaching its lower dead point, discharges a mass of pressurized liquid remaining in the retention space by means of a sealing strip positioned on the side of the secondary valve section.

3. The manually operated sprayer according to claim 1 or 2, wherein the piston seal-releasing means includes a pair of piston ribs spatially formed on the inner wall of the cylinder and designed partly to deform the skirt-like valve-sealing strip when pressed thereagainst.

4. The manually operated sprayer according to claim 1 or 2, wherein the piston seal-releasing means of the pump mechanism includes a pair of annular piston grooves spatially formed in the inner wall of the cylinder to allow the loose insertion of the skirt-like piston-sealing strip.

5. The manually operated sprayer according to claim 1 or 2 which further comprises a push button received in a push button housing so as to be moved vertically and rotated, the push button having a lateral wall; a joint rotatably fitted to the lateral wall of the push button and provided with a liquid path communicating with a liquid path formed in the push button; and an elongate nozzle whose forward end has an ejection hole communicating with a liquid path formed in the joint through a liquid path provided in a spinner and which is fitted to the joint to extend along the lateral wall thereof.

6. The manually operated sprayer according to claim 5, which further comprises joint fall off-preventing means provided with an annular groove and a projection engageable therewith and formed on the push button and joint, and wherein the joint is integrally provided with a first sealing strip disposed at the fitting end of the joint and a second sealing strip positioned on the lateral wall of the fitting end.

7. The manually operated sprayer according to claim 5, which further comprises a safety device including a blind cylindrical push button cover which is set on the liquid container and whose peripheral wall has a vertical groove into which the joint is fitted and a horizontal groove intersecting the vertical groove at right angles.

8. The manufally operated sprayer according to claim 1 or 2, which further comprises a push button received in a push button housing so as to be moved vertically and rotated, the push button having an inner wall; radially extending ribs formed on the inner wall of the push button; and a stopper formed in the push button for preventing the depression of the push button when pressed against the ribs.

9. The manually operated sprayer according to claim 8, wherein the stopper has notches therein, and depression projections are formed on the outer periphery of the push button to depress the inner wall of the push button housing, and recesses are formed in those portions of the inner wall of the push button housing which lie behind the notches of the stopper, the stopper being integrally formed with the push button housing.

10. The manually operated sprayer according to claim 8, which further comprises a joint provided with a liquid path communicating with a liquid path formed in the push button and rotatably fitted to the lateral wall of the push button; a spinner having a liquid path therein; and an elongate nozzle whose forward end has an ejection hole communicating with the liquid path of the joint through the liquid path of the spinner, and which is fitted to the joint to extend along the lateral wall of the joint.

11. The manually operated sprayer according to claim 9, wherein the safety device further comprises a pair of partly spherical projections disposed on both sides of the respective recesses formed in the inner wall of the push button housing.

12. The manually operated sprayer according to claim 9, which comprises a plurality of depression projections equiangularly arranged around the lower end portion of the push button housing, a corresponding number of notches being formed in the stopper and a corresponding number of recesses being formed in the inner wall of the push button housing, and elongate slots provided between the respective adjacent depression projections so as to extend vertically from the lower end of the push button housing.

13. The manually operated sprayer according to claim 12, wherein the depression projections are formed on the extensions of the respective radially arranged ribs.

14. The manually operated sprayer according to claim 13, wherein the depression projections take a partly columnar form; and the projections formed on the inner wall of the push button housing are shaped into a partly spherical form.

15. The manually operated sprayer according to claim 12, wherein the safety device further comprises a pair of partly spherical projections disposed on both sides of the respective recesses formed in the inner wall of the push button housing.

16. The manually operated sprayer according to claim 12, which further comprises a joint provided with a liquid path communicating with a liquid path formed in the push button and rotatably fitted to the lateral wall of the push button; a spinner having a liquid path therein; and an elongate nozzle whose forward end has an ejection hole communicating with the liquid path of the joint through the liquid path of the spinner, and which is fitted to the joint to extend along the lateral wall of the joint.

* * * * *